United States Patent [19]

Stephenson et al.

[11] 4,269,630

[45] May 26, 1981

[54] TWO-STEP PROCESS AND COMPOSITION FOR CLEANING POLISHED SURFACES

[75] Inventors: George M. Stephenson, 190 Chestnut Ridge, Bethel, Conn. 06801; William Colucci, Danbury, Conn.

[73] Assignee: George M. Stephenson, Bethel, Conn.

[21] Appl. No.: 80,588

[22] Filed: Oct. 1, 1979

[51] Int. Cl.[3] ..... B08B 3/08

[52] U.S. Cl. ..... 134/26; 134/40; 252/153; 252/170; 252/171

[58] Field of Search ..... 134/26, 40; 252/153, 252/170, 171

[56] References Cited

U.S. PATENT DOCUMENTS

| | | | |
|---|---|---|---|
| 3,340,199 | 9/1967 | Clay et al. | 252/171 |
| 3,728,269 | 4/1973 | Stephenson et al. | 252/171 |
| 3,806,460 | 4/1974 | Mukai et al. | 134/40 X |
| 3,903,012 | 9/1975 | Brandreth | 134/40 X |
| 3,904,430 | 9/1975 | Tipping et al. | 252/171 X |
| 3,957,531 | 5/1976 | Tipping et al. | 252/171 X |

*Primary Examiner*—Marc L. Caroff

*Attorney, Agent, or Firm*—Barry Kramer

[57] ABSTRACT

Optical components and highly-polished metal surfaces are cleaned with a first composition comprising 1,1,2-trichloro-1,2,2-trifluoroethane, isopropyl alcohol, dimethylformamide and 2-ethoxyethanol; then, while the surface is still wet with said first composition, a second composition, comprising at least about 85% 1,1,2-trichloro-1,2,2-trifluoroethane and containing less than 10 ppm of non-volatile residues, is applied to rinse the surface; and the surface is permitted to dry.

8 Claims, No Drawings

TWO-STEP PROCESS AND COMPOSITION FOR CLEANING POLISHED SURFACES

BACKGROUND OF THE INVENTION

The present invention relates to cleaning and more particularly to a composition and a process for cleaning optics and highly-polished metal surfaces.

The art is replete with cleaning compositions and processes for a wide variety of objects. For example, U.S. Pat. No. 3,957,531 to Tipping et al is concerned with a cleaning process utilizing, in one embodiment, a trichlorotrifluoroethane capable of forming an azeotrope with isopropyl alcohol as a first cleaning mixture. A second cleaning mixture designated as a rinse may contain as much or less alcohol by weight. It is apparently essential that both the first and the second cleaning mixtures comprise the same materials and be capable of forming an azeotrope. The cleaning mixture may also contain other solvents or additives including cationic, anionic and non-ionic detergents. The mixtures are disclosed as being utilized for cleaning printed circuit boards with no mention being made of application thereof to optical components or highly polished metal surfaces.

In another patent to Tipping et al, U.S. Pat. No. 3,904,430, the compositions disclosed are specifically identified as being non-azeotropic. Additionally, while the mixtures may contain trichlorotrifluoroethane, the use of isopropyl alcohol is specifically excluded. The compositions do contain auxiliary solvents, however, among these being 2-ethoxyethanol. As in the other Tipping et al disclosure mentioned above, the compositions are intended for cleaning printed circuit boards and can contain other solvents or additives.

In U.S. Pat. No. 3,340,199 to Clay et al, there is disclosed an azeotropic composition comprising trichlorotrifluoroethane, isopropyl alcohol and possibly, a surface active agent. The composition is disclosed as being useful in the cleaning of a variety of articles of metal, glass or plastic including optical components. The composition is, however, a one-step cleaner of the type which are known to leave noticable amounts of residue on the surfaces after cleaning.

In U.S. Pat. No. 3,903,012 to Brandreth, there is disclosed a water displacement composition which may contain trichlorotrifluoroethane and possibly isopropanol, as well as members selected from one or more groups of a variety of surfactants. Where any residue from the disclosed treatment remains on the non-shiny materials treated, it can be subsequently removed by dipping or spraying the article in pure solvent, such as pure trichlorotrifluoroethane. This is not disclosed as a cleaning composition suitable for cleaning optics or polished metal.

In U.S. Pat. No. 3,728,269 to Stephenson et al there is disclosed a volatile cleaning composition which may be sprayed from an aerosol can onto an article to be cleaned, for example an optical component, and requires no rubbing or wiping of the surface. The composition simply runs off the surface and evaporates. While the compositions are disclosed as including isopropyl alcohol as well as alkoxy alcohols, there is no mention of trichlorotrifluoroethane or of a second cleaning step or composition.

With all the prior art references dealing with cleaning compositions broadly and for specific purposes, there is yet a need for a cleaning composition and method which are capable of effectively and efficiently cleaning highly-polished surfaces, such as those employed in optics and highly-polished metal surfaces, without the need for rubbing which could damage the surfaces but yet which leave the surfaces free from any significant residue.

SUMMARY OF THE INVENTION

Accordingly, it is an object of the present invention to provide a new process for cleaning highly-polished metal surfaces and optics.

It is another object of the present invention to provide a new composition for cleaning highly-polished metal surfaces and optics.

These and other objects are accomplished according to the present invention which provides an improved composition and an improved process for cleaning highly-polished metal surfaces. The composition is a two-step cleaner comprising two different portions which are balanced to provide effective cleaning and drying with essentially no residue wherein: (a) a first portion for removing contaminating oils and salts which comprises, on a weight basis, from about 50 to 65% 1,1,2-trichloro-1,2,2-trifluoroethane, from about 25 to 35% isopropyl alcohol, from about 1 to 5% dimethylformamide, and from about 5 to 15% 2-ethoxyethanol; and (b) the second portion for rinsing the surface being cleaned and causing quick drying thereof which comprises, on a weight basis, at least about 85% 1,1,2-trichloro-1,2,2-trifluoroethane, which contains less than 10 ppm of non-volatile residues. The process comprises: (a) applying to the surface to be cleaned a first portion of the cleaner composition as defined above; then, (b) while the surface is still wet with said first portion, rinsing the surface with a second portion of the cleaner composition as defined above; and then (c) permitting the surface to dry. The composition is preferably packaged in two individual pressurized aerosol spray containers and the first and second portions are preferably applied by spraying.

DETAILED DESCRIPTION OF THE INVENTION

The composition of the present invention is formulated especially for, and the process of the invention effects, cleaning of highly-polished metal surfaces and optics without scrubbing but yet with the complete removal of essentially all residues. The cleaner composition is a two-step cleaner which comprises two different portions which are separately packaged but are balanced to attain the objects of the invention of providing effective cleaning and drying with essentially no residue. The two portions can be packaged in any suitable containers, such as spray containers with atomizer dispensers or aerosol spray means. It is preferred according to the present invention to package the two different portions of the compositions in separate, pressurized aerosol spray containers.

The first portion of the composition according to the invention is specifically designed for removing the contaminating oils and salts which normally accumulate on optics and highly-polished metal surfaces. The first portion will comprise a critical combination of 1,1,2-trichloro-1,2,2-trifluoroethane (trichlorotrifluoroethane), isopropyl alcohol, dimethyl formamide, and 2-ethoxyethanol. The effective cleaning action which is the object of the present invention is obtained only when the noted ingredients are employed within relatively narrow concentration ranges. Thus, the trichlorotrifluoroethane will be present at a level of from about 50 to 65% by weight, and preferably at a level of about 57% by weight of the first portion of the composition. The next most major ingredient will be the isopropyl alcohol which will be present at a level of from about 25 to about 35%, and preferably at a level of about 31%, by weight of the first portion. To provide extra cleaning strength, dimethylformamide is employed at a level of from about 1 to about 5%, and preferably at a level of about 2%, by weight of the first portion. The 2-ethoxyethanol will be present in an amount of from about 5 to 15%, and preferably at a level of about 10%, based on the weight of the first portion.

The second portion of the composition is specifically designed for rinsing the surface being cleaned from both the dissolved and suspended soil which is being removed from the surface, but also a major proportion of the first portion of the composition which remains on the surface. The second portion also functions as a drying agent in that, in addition to rinsing away a major portion of the first portion of the cleaning composition, it is fully miscible with any of the remaining first portion to form a low-boiling solution which is readily volatilized at room temperature. The second portion necessarily contains a high percentage, on the order of at least about 85% by weight, of trichlorotrifluoroethane which is highly purified to contain less than about 10 ppm of non-volatile residues. Preferably, the trichlorotrifluoroethane will be present at a level of at least 90% based on the weight of the second portion of the composition and can be employed at levels up to 100%.

It is preferable to employ a surface active agent as part of the second composition in an amount which is effective to prevent pooling or spot concentrations of residues. The surface active agents for cleaning compositions of this type are well known and can be selected from the group of compatible surfactants and can be of the cationic, anionic, or non-ionic varieties. It is particularly preferred to employ the surface active agent at an effective level up to about 1% based upon the weight of the second portion of the composition.

According to one embodiment of the invention, the second portion of the cleaning composition of the invention will contain 90% trichlorotrifluoroethane, about 9% by weight of 1,1,1-trichloroethane, and a minor amount of about 1% of an additive containing an inhibitor and a surface active agent.

According to the process of the present invention, the surface to be cleaned is sprayed with the first portion of the composition to remove contaminating oils, salts, and other displaceable soil, and is then flushed with the second portion of the composition while still wet with the first portion. During the application of both portions of the composition, the surface being cleaned is preferably held in an upright or other suitable position to obtain the most complete runoff possible. Where the object having the surface in need of cleaning is mounted, it is preferred to remove it from the mounting so that the mounting member will not become damaged. The composition is intended primarily for the maintenance of optical systems and highly-polished metal parts wherein a regimen of cleaning schedules and good housekeeping practices can be followed. The composition is designed to function without rubbing or wipping and to be mild in its action on the intended objects; however, where unusual contaminants or contamination levels are encountered or where deposits and films have age-hardened, more vigorous cleaning methods may be necessary. In these extreme circumstances, the composition of the present invention will be advantageous in obtaining effective cleaning even though one of its virtues, the lack of a need for physical contact with the surface, cannot be attained.

The following example is presented for the purpose of further illustrating and explaining the present invention and is not meant to be limiting in any regard. Unless otherwise indicated, all parts and percentages are by weight.

EXAMPLE

A first portion of a cleaning composition according to the present invention comprises, on a weight basis, 57.2% 1,1,2-trichloro-1,2,2-trifluoroethane, 30.8% isopropyl alcohol, 2% dimethylformamide, and 10% 2-ethoxyethanol. This portion of the cleaning composition is packaged within a first aerosol container fitted with a spray nozzle. A second portion of the composition of the invention intended for rinsing the surface being cleaned comprises, on a weight basis, 90% 1,1,2-trichloro-1,2,-trifluoroethane and 10% of a commercial solvent sold under the trademark Tri-ethane by PPG Industries, Inc. The Tri-ethane solvent is identified by the manufacturer as 1,1,1-trichloroethane with a stabilizer or inhibitor and surface active agent which is said to prevent the solvent from attacking metals but which also has the effect of preventing pooling of residues. This second portion of the composition is also packaged in a pressurized aerosol container fitted with a spray nozzle. An unmounted lens is held in a tilted position to ensure continuous draining of the cleaner from the surface while it is sprayed and completely flushed with the first portion of the cleaning composition. The excess liquid from the first portion of the composition is permitted to drain while flushing but is not wiped or permitted to dry. Immediately upon terminating application of the first portion of the composition, the second portion of the composition is sprayed onto the tilted lens to permit complete runoff. The lens is permitted to dry in ambient air with no wiping. The lens surface is essentially free of any residue, with no residue being apparent to the naked eye or during use of the lens.

The above description is for the purpose of teaching the person of ordinary skill in the art how to make and use the present invention and is not intended to detail all those obvious modifications and variations thereof which will become apparent to the person of ordinary skill in the art upon reading. It is intended, however, that all such obvious modifications and variations be included within the scope of the present invention which is defined by the following claims.

What is claimed is:

1. A composition for removing contaminating oils and salts from highly-polished surfaces comprising, on a weight basis, from about 50 to 65% 1,1,2-trichloro-1,2,2-trifluoroethane, from about 25 to 35% isopropyl alcohol, from about 1 to 5% dimethylformamide, and from about 5 to 15% 2-ethoxyethanol.

2. A composition according to claim 1 comprising about 57% 1,1,2-trichloro-1,2,2-trifluoroethane, about 31% isopropyl alcohol, about 2% dimethylformamide, and about 10% 2-ethoxyethanol.

3. A process for cleaning highly-polished surfaces with a cleaner composition comprised of two different portions, which comprises:

(a) applying to the surface to be cleaned a first portion of the cleaner comprising, on a weight basis, from about 50 to 65% 1,1,2-trichloro-1,2,2-trifluoroethane, from about 25 to 35% isopropyl alcohol, from about 1 to 5% dimethylformamide, and from about 5 to 15% 2-ethoxyethanol; then, (b) while the surface is still wet with said first portion, rinsing the surface with a second portion of the cleaner composition which comprises, on a weight basis, at least about 85% 1,1,2-trichloro-1,2,2-trifluoroethane which contains less than 10 ppm of non-volatile residues; and then (c) permitting the surface to dry.

4. A process according to claim 3 wherein the second portion of the cleaner composition further comprises a surface active agent in an amount effective to prevent pooling or spot concentrations of residues.

5. A process according to claim 4 wherein the first portion of the cleaning composition comprises about 57% 1,1,2-trichlor-1,2,2-trifluoroethane, about 31% isopropyl alcohol, about 2% dimethylformamide, and about 10% 2-ethoxyethanol.

6. A process according to claim 3 wherein the second portion of the cleaning composition comprises about 99% 1,1,2-trichloro-1,2,2-trifluoroethane and about 1% of a surface active agent to prevent pooling or spot concentrations of residues.

7. A process according to claim 6 wherein the first portion of the cleaning composition comprises about 57% 1,1,2-trichloro-1,2,2-trifluoroethane, about 31% isopropyl alcohol, about 2% dimethylformamide, and about 10% 2-ethoxyethanol.

8. A process according to either of claims 3 or 7 wherein the first and second portions of the composition of the invention are applied by spraying.

* * * * *

UNITED STATES PATENT AND TRADEMARK OFFICE

CERTIFICATE OF CORRECTION

PATENT NO. : 4,269,630

DATED : May 26, 1981

INVENTOR(S) : TWO-STEP PROCESS AND COMPOSITION FOR CLEANING POLISHED SURFACES

It is certified that error appears in the above—identified patent and that said Letters Patent is hereby corrected as shown below:

In Claim 5, line 3 thereof, "trichlor" should read --trichloro--.

Signed and Sealed this

*First* Day of *September 1981*

[SEAL]

*Attest:*

GERALD J. MOSSINGHOFF

*Attesting Officer*

*Commissioner of Patents and Trademarks*